United States Patent [19]

Argaman

[11] Patent Number: 4,647,880

[45] Date of Patent: Mar. 3, 1987

[54] MICROWAVE DIODE PHASE SHIFTER

[75] Inventor: Gideon Argaman, Kiryat Tivon, Israel

[73] Assignee: State of Israel - Ministry of Defense, Haifa, Israel

[21] Appl. No.: 820,287

[22] Filed: Jan. 17, 1986

[30] Foreign Application Priority Data

Apr. 16, 1985 [IL] Israel ..... 74937

[51] Int. Cl.[4] ..... H01P 1/185

[52] U.S. Cl. ..... 333/164; 333/161; 333/246

[58] Field of Search ..... 333/156, 157, 160, 161, 333/164, 246, 138–140

[56] References Cited

U.S. PATENT DOCUMENTS 3,436,691 4/1969 Hoffman et al. ..... 333/164
3,491,314 1/1970 White ..... 333/160 X
3,916,349 10/1975 Ranghelli et al. ..... 333/164
4,254,383 3/1981 Wolfe ..... 333/164 X
4,331,942 5/1982 Matsunaga et al. ..... 333/246 X

*Primary Examiner*—Marvin L. Nussbaum
*Attorney, Agent, or Firm*—Townsend and Townsend

[57] ABSTRACT

A two-state microwave signal phase shifter comprising a first signal conductor disposed in a first plane, a second signal conductor electromagnetically coupled to the first signal conductor and disposed in overlapping relationship therewith in a second plane parallel to and spaced from the first plane, a ground plane element disposed in a third plane parallel to and spaced from the first plane, third and fourth signal conductors connected to the second signal conductor and disposed perpendicular to the second signal conductor; fifth and sixth conductors disposed in the second plane; switching diodes connecting the opposite ends of the third and fourth conductors to the fifth and sixth conductors; and a seventh conductor connected to the fifth and sixth conductors.

17 Claims, 6 Drawing Figures

MICROWAVE DIODE PHASE SHIFTER

FIELD OF THE INVENTION

The present invention relates to phase shifters generally and more particularly to diode phase shifters operative at microwave frequencies.

BACKGROUND OF THE INVENTION

A number of different types of diode phase shifters employing P.I.N. type diodes are well known and are incorporated in RF (radio frequency) signal processing circuitry and in electronically scanned antennas. The selection of the particular type of diode phase shifter for a given application is made on the basis of considerations including bandwidth, insertion loss, insertion phase displacement accuracy, standing wave ratio and power capacity.

Prior art diode phase shifters of this general type employ lossy transmission lines, series connected DC block elements and other discontinuities which result in insertion and return losses which are unacceptable for some applications.

SUMMARY OF THE INVENTION

The present invention seeks to provide a diode phase shifter operative at microwave frequencies which is characterized by very low insertion losses and return losses over a given bandwidth. More specifically, the present invention seeks to provide a diode phase shifter of the transmission type which avoids the disadvantages associated with prior art diode phase shifters having discontinuities on the transmission line which connects input and output connectors, i.e. at DC blocks, T junctions and bias network connections.

There is thus provided in accordance with a preferred embodiment of the present invention a two-state microwave signal phase shifter comprising a first signal conductor disposed in a first plane, a second signal conductor electromagnetically coupled to the first signal conductor and disposed in overlapping relationship therewith in a second plane parallel to and spaced from the first plane, a ground plane element disposed in a third plane parallel to and spaced from the first plane, third and fourth signal conductors connected to the second signal conductor and disposed perpendicular to the second signal conductor; fifth and sixth conductors disposed in the second plane; switching diodes connecting the opposite ends of the third and fourth conductors to the fifth and sixth conductors; and a seventh conductor connected to the fifth and sixth conductors.

Additionally in accordance with a preferred embodiment of the present invention there is provided a multistage phase shifter comprising a plurality of two-state phase shifters of the type described hereinabove and apparatus for providing individual control of the bias voltages at each of the two-state phase shifters.

Further in accordance with a preferred embodiment of the present invention, the two-state phase shifter comprises a dielectric substrate wherein the signal conductors are formed by planar conducting lines printed on opposite surfaces of the substrate. Metal shoulders, defining a conducting channel, referred to hereinafter as ground plane metal, support the substrate.

Additionally in accordance with an embodiment of the present invention, the first signal conductor is disposed on the side of the substrate facing ground plane metal and is connected directly between input and output connectors of the phase shifter, while the second signal conductor is disposed in overlapping relationship thereto on the opposite surface of the substrate so as to couple microwave energy from the first signal conductor while maintaining continuity in the electromagnetic field an in the characteristic impedance of the first signal conductor.

The switching diodes are preferably P.I.N. type diodes and are bonded in series between the third and fourth conductors, in the form of identical short wide stubs which are connected to the second signal conductor, a quarter wavelength apart, and the fifth and sixth conductors, which are in the form of two identical short narrow stubs which are connected to the second signal conductor, a quarter wavelength ($\lambda/4$) apart. The opposite ends of the fifth and sixth conductors are connected by plated through holes to the seventh conductor which is in contact with the ground plane metal.

The first signal conductor and the ground plane metal define a pair of "Inverted Suspended Microstrip Transmission Lines". The second signal conductor, the third, fourth, fifth and sixth conductors and the ground plane metal form a transmission line known as a "Suspended Microstrip".

The third, fourth, fifth and sixth conductors define a capacitive load when the P.I.N. diodes exhibit high impedance, and define series connected capacitive and inductive loads when the P.I.N. diodes exhibit low impedance. These complex loads on the transmission line together define a "Loaded-Line Phase Shifter Bit".

The phase shifter of the present invention has the advantage that it can easily be hermetically sealed since the active devices and the main signal line are located on opposite sides of a dielectric substrate board.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1:
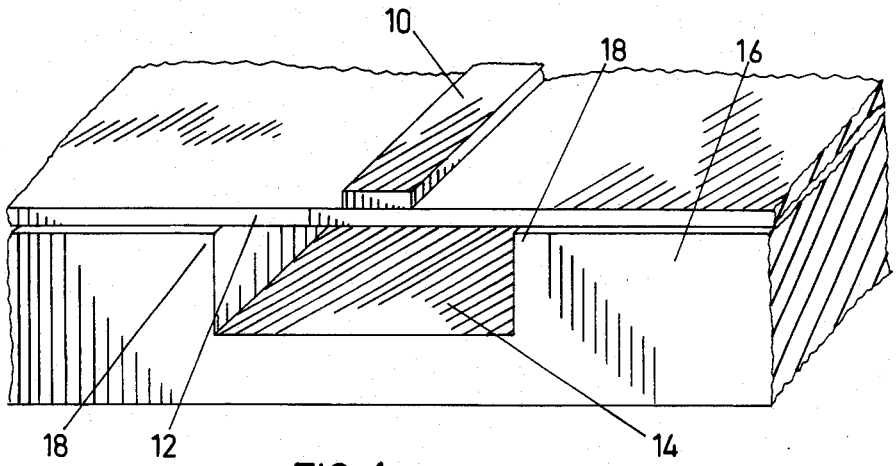
FIG. 1 is a perspective illustration of a "Suspended Microstrip Line" constructed and operative in accordance with a preferred embodiment of the present invention.
Figure 2:
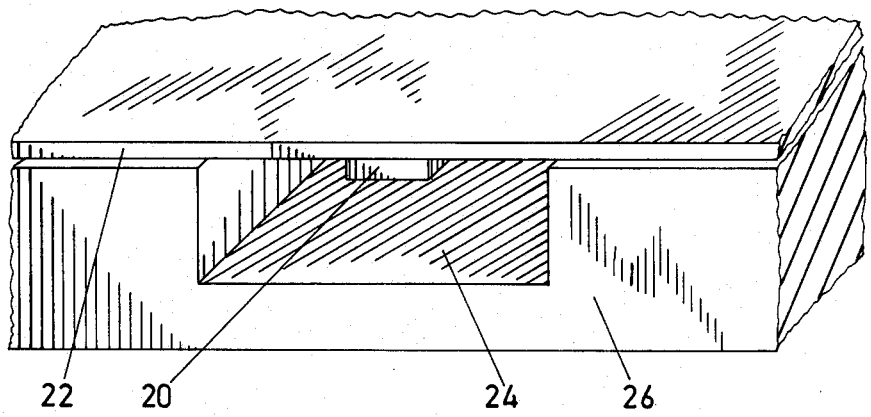
FIG. 2 is a perspective illustration of an "Inverted Suspended Microstrip Line"

Reference is now made to FIGS. 1 and 2 which illustrate respectively a suspended microstrip line and an inverted microstrip line as defined hereinabove. The suspended microstrip line is seen in FIG. 1 to comprise a conductor strip 10, typically formed of copper, which is deposited, as by conventional photolithography techniques, onto a dielectric substrate 12, which serves as a mechanical support for conductor 10. The conductor 10 and substrate 12 are arranged to overlie and extend generally parallel to a channel 14 formed in a body 16 of solid electrically conducting metal, such as copper, the substrate 12 being supported on the shoulders 18 of body 16, as defined by channel 14.

The configuration illustrated in FIG. 1 is characterized in that nearly all of the electromagnetic energy along conductor strip 10 is concentrated between the conducting strip 10 and the conducting surfaces defining channel 14. The thickness and dielectric constant of dielectric substrate 12, the width and height of conductor strip 10 and the depth and width of channel 14 determine the characteristic impedance of the transmission line defined by conductor strip 10. The inverted suspended microstrip line illustrated in FIG. 2 comprises a conductor strip 20 which is suspended beneath a dielectric substrate 22 and supported thereby over and generally parallel to a channel 24 defined in a body 26 of electrically conductive material. Here, also, similarly to the suspended microstrip line of FIG. 1, nearly all of the electromagnetic energy along conductor strip 20 is concentrated between the conducting strip 20 and the conducting surfaces of channel 24.

Figure 3:
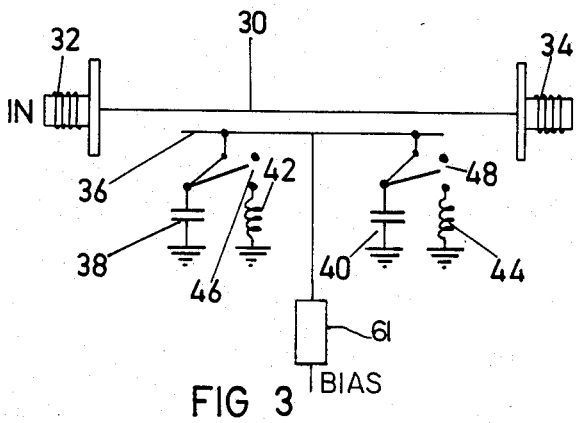
FIG. 3 is an electrical diagram of the equivalent circuit of the "Loaded Line Phase Shifter" constructed and operative in accordance with a preferred embodiment of the present invention.

Reference is now made to FIG. 3, which illustrates the electrical equivalent circuit of the phase shifting bit of the present invention. A transmission line 30 is directly connected to input and output connectors 32 and 34 respectively. A second conducting line 36, having a length approximately equal to $\lambda/4$ is coupled inductively to the transmission line 30.

First and second identical capacitive loads 38 and 40 are permanently connected to coupled line 36 at locations which are separated by a distance approximately equal to $\lambda/4$. First and second inductive loads 42 and 44 are connected via respective switches 46 and 48 to the respective capacitive loads 38 and 40. When switches 46 and 48 are closed, the net loading of coupled line 36 has a capacitive characteristic. When switches 46 and 48 are open, the inductive loads 42 and 44 are in parallel to the capacitive loads 38 and 40. The inductive loads 42 and 44 and the capacitive loads 38 and 40 are calibrated such that when they are connected in parallel, they have a net inductive characteristic. Lines 30 and 36, inductive loads 42 and 44 and capacitive loads 38 and 40 are designed to provide good matching between the input and output connectors 32 and 34 respectively and to provide a predetermined transmission phase difference across the connectors when switches 46 and 48 are shifted between open and closed positions.

Figure 4:
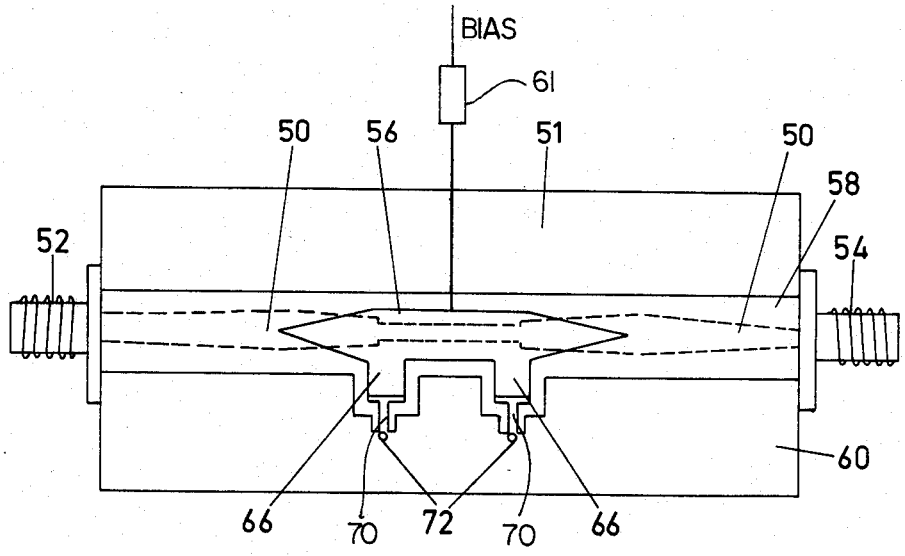
FIG. 4 is a top view illustration of a phase shifter bit incorporating two coupled microstrip lines embodying the present invention.
Figure 5:
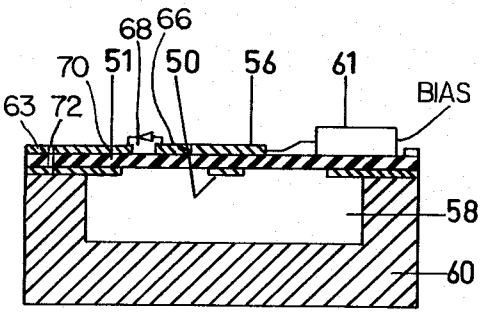
FIG. 5 is a side view sectional illustration of the phase shifter bit of FIG. 4.

Reference is now made to FIGS. 4 and 5 which illustrate in respective top view and side sectional view illustrations, a phase shifter bit constructed and operative in accordance with a preferred embodiment of the present invention. An inverted suspended microstrip transmission line 50 is deposited on the underneath surface of a dielectric substrate 51 and forms a lower conductor connecting respective input and output connectors 52 and 54. A suspended microstrip line 56 is deposited above transmission line 50 on the upper surface of substrate 51 and forms an upper conductor opposite to transmission line 50. Both lines 50 and 56 are disposed to lie in generally parallel relationship over a channel 58 formed in a body 60 of electrically conductive material, such as copper.

It is seen in FIG. 4 that microstrip lines 50 and 56 are of non-uniform width and that line 56 is wider than line 50 at the central section of the phase shifter bit. The width ratio of the line 50 to line 56, the thickness and dielectric constant of the dielectric substrate 51 and the depth of the channel 58 determine the self impedance and mutual impedance of coupled lines 50 and 56. These impedances are selected so as to attain good matching to the characteristic impedance Z of the input and output terminals while loaded.

As seen in FIG. 4, line 56 tapers to a relatively narrower configuration adjacent each end of line 56 while at the corresponding location therebelow, line 50 widens. This particular shaping of the microstrip lines is provided in order to gradually change the electromagnetic field from that of a single inverted suspended microstrip line to that of a pair of coupled suspended and inverted suspended microstrip lines. This gradual transformation of the electromagnetic field ensures low transmission and return losses.

Line 56 is coupled via an RF choke 61 to a bias input.

Figure 6:
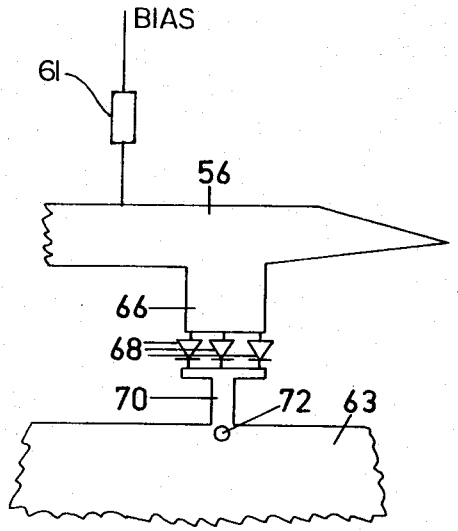
FIG. 6 is a top view illustration of the P.I.N. diode switched loads connected to the upper coupled microstrip line.

Referring now to FIG. 6, there is seen a detailed view of the load connections to suspended microstrip 56. Elements 66 and 70 are complex loading impedances which load transmission line 50 and are equivalent to loading elements 38, 40, 42 and 44 in the equivalent circuit diagram of FIG. 3.

A short wide transmission line 66 is connected at one end thereof to line 56. The opposite end of line 66 is connected via a plurality of switching P.I.N. diodes 68, such as a beam lead, to one end of a short narrow strip 70, whose other end is electrically connected to a conductive layer 63 disposed above dielectric substrate 51. Both narrow strip 70 and conductive layer 63 are electrically connected by means of a plated through hole 72 in substrate 51 to a conducting surface of channel 58.

Switching diodes 68 may be selectively biased by conventional techniques into conducting or non-conducting states. When the diodes 68 are biased into a non-conducting state, the overall loading impedance has a capacitive nature. When the diodes 68 are biased into a conducting state, and inductive element, constituted by strip 70, is connected in parallel with the capacitive element constituted by strip 66, providing an overall inductive loading impedance as described above an connection with the equivalent circuit diagram of FIG. 3.

By switching the diodes 68 from one state to another, one changes the transmission phase across connectors 52 and 54 by an amount which is termed the "phase shift". In order to achieve an analog phase shifter bit, varactor diodes may be used instead of P.I.N. diodes. By changing the biasing voltage, the varactor diodes change gradually their nature and the overall complex loading is changed, changing the transmission phase.

It will be appreciated by persons skilled in the art that the phase shifter bit described hereinabove may be used in a modular phase shifter comprising a plurality of discrete and analog phase shifter bits connected in cascade. Each phase shifter bit may be designed and operated to provide any appropriate predetermined phase shift. Thus any designed phase shift may be achieved by this apparatus.

In general, the smaller the phase shift angle chosen for a given stage, the wider is the bandwidth that may be attained.

It is also appreciated that by suitable selection of parameters, high power microwave energy can be phase shifted with low insertion loss and standing wave ratio. This apparatus is useful in both transmission and reception of microwave signals and is thus useful in electronically scanning antennas and other low insertion loss RF processors.

It will be appreciated by persons skilled in the art that the present invention is not limited by what has been particularly shown and described hereinabove. Rather the scope of the present invention is defined only by the claims which follow:

I claim:

1. A two state microwave signal phase shifter comprising:

a first signal conductor disposed in a first plane and having a non-uniform width therein along its length between its input and output terminals, its non-uniform width comprising a pair of tapered sections each beginning in a wide portion at a location adjacent a respective one of said terminals and ending in a narrow portion at the central section of said first signal conductor, a second signal conductor electromagnetically coupled to said first signal conductor and disposed in overlapping relationship therewith in a second plane parallel to and spaced apart from the first plane, said second signal conductor having a non-uniforming width along its length, its non-uniform width comprising a pair of tapered sections each beginning in a narrow portion proximate a respective one of said locations and ending in a wide portion at the central section of said second signal conductor, said second signal conductor wide portion being wider than said first signal conductor wide portion, such that said electromagnetic coupling couples microwave energy from said first signal conductor to said second signal conductor while maintaining continuity in the electromagnetic field and in the characteristic impedance of said first signal conductor;

a ground plane element disposed in a third plane parallel to and spaced apart from the first plane;

third and fourth signal conductors connected to said second signal conductor and disposed perpendicular to the second signal conductor;

fifth and sixth conductors disposed in said second plane;

switching means connecting the opposite ends of said third and fourth conductors to said fifth and sixth conductors; and a seventh conductor for connecting said fifth and sixth conductors to said ground plane element.

2. A multi-stage phase shifter comprising:

a plurality of two-state phase shifters each including:

a first signal conductor disposed in a first plane and having a non-uniform width therein along its length between its input and output terminals, its non-uniform width comprising a pair of tapered sections each beginning in a wide portion at a location adjacent a respective one of said terminals and ending in a narrow portion at the central section of said first signal conductor, a second signal conductor electromagnetically coupled to said first signal conductor and disposed in overlapping relationship therewith in a second plane parallel to and spaced apart from the first plane, said second signal conductor having a non-uniform width along its length, its non-uniform width comprising a pair of tapered sections each beginning in a narrow portion proximate a respective one of said locations and ending in a wide portion at the central section of said second signal conductor, said second signal conductor wide portion being wider than said first signal conductor wide portion, such that said electromagnetic coupling couples microwave energy from said first signal conductor to said second signal conductor while maintaining continuity in the electromagnetic field and in the characteristic impedance of said first signal conductor;

a ground plane element disposed in a third plane parallel to and spaced apart from the first plane;

third and fourth signal conductors connected to said second signal conductor and disposed perpendicular to the second signal conductor;

fifth and sixth conductors disposed in said second plane;

switching means connecting the opposite ends of said third and fourth conductors to said fifth and sixth conductors; and a seventh conductor for connecting said fith and sixth conductors to said ground plane element; and means for providing individual control of said switching means at each of the two-state phase shifters.

3. Apparatus according to claim 1 and wherein said twostate phase shifter comprises a dielectric substrate wherein the signal conductors are formed by planar conducting lines printed on opposite surfaces of the substrate.

4. Apparatus according to claim 2 and wherein said twostate phase shifter comprises a dielectric substrate wherein the signal conductors are formed by planar conducting lines printed on opposite surfaces of the substrate.

5. Apparatus according to claim 1 and wherein said switching means comprise switching diodes.

6. Apparatus according to claim 2 and wherein said switching means comprise switching diodes.

7. Apparatus according to claim 1 wherein said substrate is supported above a channel formed in a solid metal conductor, the conducting surface of said channel defining said ground plane element as metal and said first signal conductor is disposed on the side of the substrate facing the ground plane metal and is connected directly between said input and output terminals, while the second signal conductor is disposed in overlapping relationship thereto on the opposite surface of the substrate.

8. Apparatus according to claim 2 wherein said substrate is supported above a channel formed in a solid metal conductor, the conducting surface of said channel defining said ground plane element as metal and said first signal conductor is disposed on the side of the substrate facing the ground plane metal and is connected directly between said input and output terminals, while the second signal conductor is disposed in overlapping relationship thereto on the opposite surface of the substrate.

9. Apparatus according to claim 5 and wherein said switching diodes are P.I.N. type diodes and are bonded in series between said third and fourth conductors, which are in the form of identical short wide stubs which are connected to the second signal conductor, a quarter wavelength apart, and the fifth and sixth conductors, which are in the form of two identical short narrow stubs which are connected to the second signal conductor, a quarter wavelength apart.

10. Apparatus according to claim 5 and wherein the opposite ends of the fifth and sixth conductors are connected by plated through holes to the seventh conductor which is in contact with the ground plane metal.

11. Apparatus according to claim 7 and wherein said first signal conductor and the ground plane metal define a pair of Inverted Suspended Microstrip Transmission Lines.

12. Apparatus according to claim 11 and wherein said second signal conductor, said third, fourth, fifth and sixth conductors and said ground plane metal define a Suspended Microstrip.

13. Apparatus according to claim 10 and wherein said third, fourth, fifth and sixth conductors define a capacitive load when the P.I.N. diodes exhibit high impedance, and define series connected capacitive and inductive loads when the P.I.N. diodes exhibit low impedance.

14. Apparatus according to claim 1 and wherein the spacing between said first and second planes is less than the spacing between said first and third planes.

15. Apparatus according to claim 2 and wherein the spacing between said first and second planes is less than the spacing between said first and third planes.

16. Apparatus according to claim 1 and wherein said third and fourth conductors are separated by approximately $\lambda/4$ where $\lambda$ is the wavelength of the transmitted microwave energy passing through said phase shifter.

17. Apparatus according to claim 2 and wherein said third and fourth conductors are separated by approximately $\lambda/4$ where $\lambda$ is the wavelength of the transmitted microwave energy passing through said phase shifter.

* * * * *